United States Patent [19]

Reale

[11] Patent Number: 5,003,783

[45] Date of Patent: Apr. 2, 1991

[54] JOULE-THOMSON COOLER

[75] Inventor: Serge Reale, Grenoble, France

[73] Assignee: L'Air Liquide, Societe Anonyme pour l'Etude et l'Exploitation des Procedes Georges Claude, Paris, France

[21] Appl. No.: 493,706

[22] Filed: Mar. 15, 1990

[30] Foreign Application Priority Data

Mar. 15, 1989 [FR] France ..... 89 03383

[51] Int. Cl.[5] ..... F25B 19/02

[52] U.S. Cl. ..... 62/51.2; 62/467

[58] Field of Search ..... 62/51.2, 467

[56] References Cited

U.S. PATENT DOCUMENTS

| | | | |
|---|---|---|---|
| 3,257,823 | 6/1966 | Hogan | 62/51.2 |
| 3,413,819 | 12/1968 | Hansen | 62/51.2 |
| 3,691,784 | 9/1972 | Nicholds et al. | 62/51.2 |
| 3,728,868 | 4/1973 | Longsworth | 62/51.2 |
| 4,381,652 | 5/1983 | Kumimoto | 62/51.2 |
| 4,569,210 | 2/1986 | Albagnac | 62/51.2 |
| 4,570,457 | 2/1986 | Campbell | 62/51.2 |
| 4,631,928 | 12/1986 | Walker | 62/51.2 |

FOREIGN PATENT DOCUMENTS

| | | |
|---|---|---|
| 0020111 | 12/1980 | European Pat. Off. . |
| 0245164 | 11/1987 | European Pat. Off. . |
| 2547999 | 4/1977 | Fed. Rep. of Germany . |
| 597993 | 12/1925 | France . |
| 2039956 | 1/1971 | France . |
| 2176544 | 11/1973 | France . |
| 757814 | 8/1980 | U.S.S.R. . |

*Primary Examiner*—Ronald C. Capossello

*Attorney, Agent, or Firm*—Young & Thompson

[57] ABSTRACT

A closure member (16) of the cooler is controlled by a bulb actuator (18) which defines an auxiliary gas volume (24) located in the cold part of the cooler and connected to a chamber (21) of very much larger volume located in the warm part of the cooler. Application in the cooling of infrared ray detectors.

16 Claims, 1 Drawing Sheet

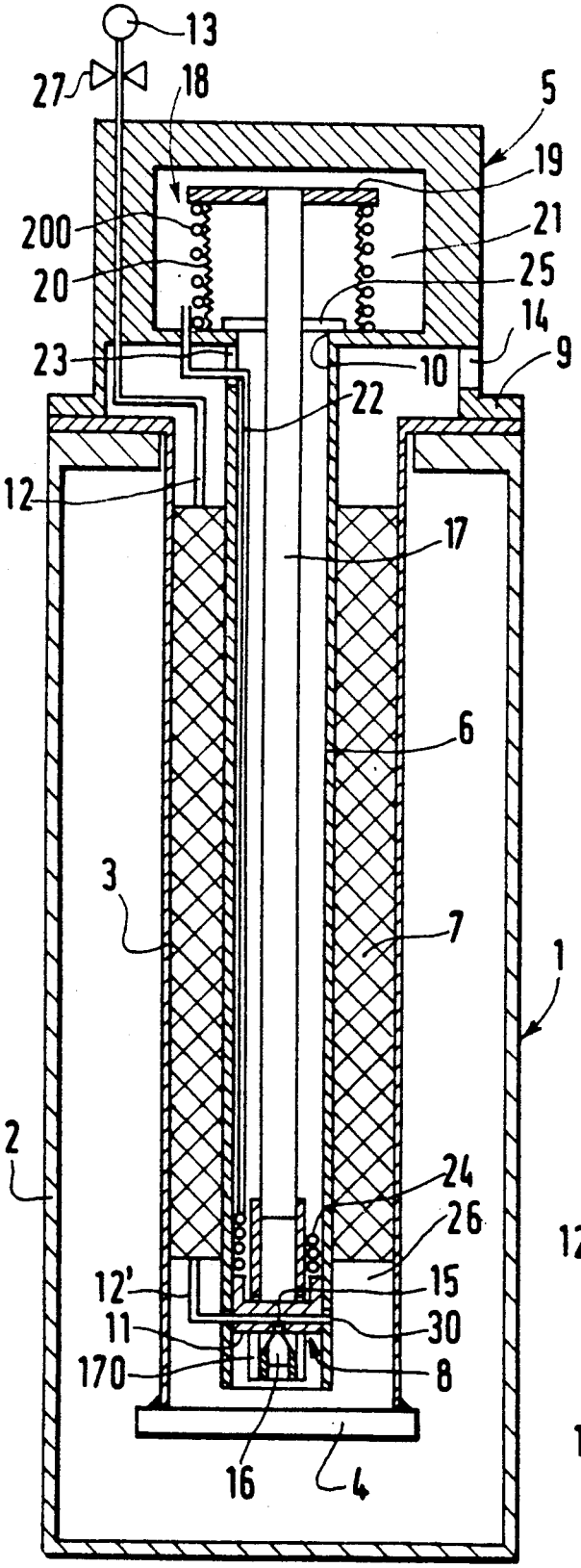
FIG.1
FIG.2
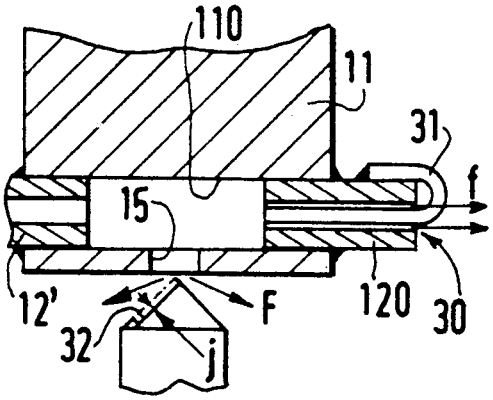
FIG.3
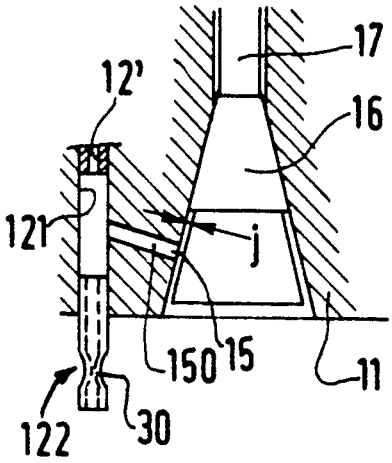

JOULE-THOMSON COOLER

The present invention relates to Joule-Thomson coolers of the type comprising a high pressure working gas pipe terminating in an expansion orifice formed in the seat of a closing valve and opening into a low pressure discharging circuit in heat exchange relation to the high pressure pipe, a closure member adapted to reduce the section of the passage of the gas expanded at the end of the cooling of the cooler, and actuating means for suddenly shifting the closure member from a first position, in which the expansion orifice is uncovered, to a second position in which said orifice is at least partly covered. A cooler of this type, with electric actuating means, is described in the document EP-A-No. 0245164 in the name of the applicant.

An object of the present invention is to provide a cooler of this type which is rapidly actuated and is particularly reliable and simple to construct.

For this purpose, according to the invention, the actuating means comprise a bulb actuator including means defining a volume of auxiliary gas disposed in the cold part of the cooler in direct or indirect thermal exchange relation to a low pressure return circuit zone for the working gas, and connected to a chamber of much greater volume disposed in the warm part of the cooler.

The document FR-A-No. 2039956 discloses a Joule-Thomson cooler having a progressive actuation as the end of the auxiliary gas pipe is immersed in the liquid coolant at the bottom of the cooler. Furthermore, the actuator of this document operates by suction when the bulb pressure becomes lower than the ambient pressure, which gives rise to problems in utilizations at high altitude and in particular in the aeronautic field.

According to particular features of the invention:

the chamber is delimited by a bellows to which the actuating rod of the closure member is connected, the bellows exerting a force in the direction tending to close the closure member;

the auxiliary gas is liquefiable at a temperature higher than the temperature of the start of the liquefaction of the working gas and relatively close to this temperature.

"Relatively close temperature" is intended to mean, as will be clear hereinafter, a temperature reached at an instant very close to the instant at which the working gas starts to be liquefied.

Embodiments of the invention will now be described with reference to the accompanying drawings, in which:

FIG. 1 is a diagrammatic longitudinai sectional view of a Joule-Thomson cooler according to the invention;

FIG. 2 is a diagrammatic view to an enlarged scale of the closing valve of the cooler shown in FIG. 1, and FIG. 3 is a similar view of a variant of the closing valve.

The Joule-Thomson cooler represented in FIG. 1 is combined with a Dewar vessel 1 having a U-shaped section comprising an outer case 2 and a central well 3 which is open at the upper end and closed at its lower end by an element 4 to be cooled, which is for example an infrared ray detector in the form of a disc.

The cooler itself comprises a head 5, a tubular core 6, a coiling 7 for the circulation of the working gas, and a valve 8 having two flows. This cooler is miniaturized so as to reduce its thermal inertia, the inside diameter of the well 3 being on the order of 4 to 5 mm.

The head 5 constitutes a cylindrical housing which is downwardly extended by a peripheral flange 9 fixed to the upper side of the Dewar vessel. The housing defines in its lower side a central opening 10 from which the core 6 extends, this core carrying a closing valve seat 11 at its lower end.

The coiling 7 comprises a pipe 12 for a high pressure working gas which has an upstream end extending through the head 5 and connected to a source 13 of working gas under high pressure, and is helically coiled between the core 6 and the well 13 in a manner known per se. This coiling 7 terminates in the vicinity of the lower end of the core 6 and defines between its coils a path for the return of the working gas after expansion, this path leading to the surrounding atmosphere through ports 14 provided in the flange 9. THe pipe 12 terminates in a short pipe section 12' fitted in the seat 11 and communicating with an expansion orifice 15 provided in the seat.

The valve 8 comprises a closure member 16 fixed to the lower end of an actuating rod 17, and a bulb actuator 18.

In the embodiment shown in FIGS. 1 and 2, the seat 11 includes a transverse bore 110 into which opens in a central manner the expansion orifice 15 and in which the end of the pipe section 12' is fitted. The closure member is constructed in the form of a conical needle 16 connected to a tubular extension 170 of the rod 17. The end of the transverse bore 110 is provided with a constriction 30 providing a permanent escape flow f much lower (on the order of 1/5 th to 1/10 th) than the nominal flow F of the orifice 15. As shown in FIG. 2, the constriction may be provided by a needle 31 fitted with a clearance in a tube section 120 fitted in the bore 110. As a variant, as shown diagrammatically in FIG. 2, the escape flow may be ensured by a planar grinding 32 in the conical end portion of the needle 16 defining an escape clearance j.

The rod 17 extends upwardly throughout the core 6 up to the head 5 where it is suspended from a horizontal plate 19. A metal bellows 20 which is typically composed of stainless steel, connects with a sealed joint the periphery of this plate to the periphery of the opening 10. An annular chamber 21 is in this way defined in the head 5 around the bellows 20.

A capillary tube 22 extending from the chamber 21 through, with a sealed joint, the lower wall of this chamber, extends radially in a sealed manner an orifice 23 provided at the upper end of the core 6 and downwardly throughout the length of this core, between the latter and the rod 17, and terminates in a small volume constituting a heat exchanger 24 defined by a small number of coils (three coils in the represented embodiment) brazed to the lower side of the core 6 and located adjacent to the seat 11. The lower end of the capillary tube 22 is hermetically closed.

The volume of the heat exchanger 24 is much smaller than the volume of the chamber 21, the exchanger having for example a volume of 2 cu.mm and the chamber 21 a volume of from 50 cu.mm to 150 cu.mm. The chamber 21 and the capillary tube 22 are filled with an auxiliary gas satisfying the following conditions:

temperature at the start of the liquefaction higher than the temperature of the start of the liquefaction of the working gas, bearing in mind pressure drops in the low pressure circuit and relatively in the neighbourhood of this temperature, and a triple point relatively in the neighbourhood of the same temperature;

critical temperature lower than the minimum temperature of the environment, for example lower than −40° C. so as to guarantee that the auxiliary gas remains in the gaseous state so long as the apparatus is not cold;

preferably absence of toxicity, instability and reaction with helium (so as to permit carrying out sealing tests by mixing therewith a few percentages of helium).

According to an aspect of the invention, the bellows 20 is so constructed as to have an elasticity tending to close the closure member 16, this closing force being compensated for by the inflation pressure of the auxiliary gas on the active surface of the bellows 20.

According to a particular feature of the invention, in order to avoid problems of creep on aging of the material of the bellows, the force causing the extension of the bellows (on the order of 200 g) is provided by a spring 200 disposed around the bellows 20 between the plate 19 and the inner end of the chamber 21. The spring moreover permits increasing the closing force and therefore contributing to an increase in the rapidity of closure of the closure member and obtaining variable performances by acting on the inflation pressure of the bulb with different types of condensible gases and/or by positioning the heat exchanger 24 at variable heights in the core 6, or by disposing it outside the core 6 in the low pressure return circuit of the working gas, in the coiling 7, which permit improving the thermal exchanges between the cryogenic working liquid and the auxiliary gas controlling the bulb.

The working gas is preferably argon or nitrogen and the auxiliary gas methane, $CO_2$, ethylene or krypton.

The pressure of the working gas is so chosen as to permit the operation of te actuator 18, which will be described hereinafter, irrespective of the temperature of the environment and irrespective of the pressure drops of the low pressure circuit, which may reach to 6 to 8 bars at the end of the cooling and resulting in the establishment of a similar pressure within the bellows 20. For example, an inflation pressure of the working gas may be chosen to be on the order of 5 to 30 absolute bars, depending on the temperature of the start of the liquefaction or on the solidification of the working gas.

At rest, the pressure of the auxiliary gas compresses the bellows and this lowers the rod 17 until a stop 25 carried by the latter bears against the lower wall of the chamber 21. The closure member 16 is then shifted away from its seat through an axial distance on the order of a tenth of a millimeter. The high pressure gas may be considered to flow freely, after its expansion, in the lower space 26 of the well 3 adjacent to the element 4.

When the device is cooled, an electrically operated valve 27 controlling the pipe 12 is opened. The high pressure gas flows in the pipe 12 and is expanded at a high flow through the orifice 15. The expanded and consequently cooled gas rises between the coils of the coiling 7 up to the point where it is discharged to the surrounding atmosphere through the ports 14 while cooling in a counter current manner the high pressure working gas. Consequently, the temperature of the expanded gas decreases more and more until formation of liquid in the chamber 26.

Bearing in mind the pressure drops in the low pressure circuit, the temperature in the chamber 26 is then about 120° K. and is obtained after a period of cooling on the order 1 second. A very short period of time before this moment, the temperature passes through the liquefaction or solidification temperature of the working gas under the inflation pressure of the actuator 18. The small volume of working gas within the exchanger 24 is then suddenly liquefied or solidified and this causes the pressure in the chamber 21 to crop below the pressure prevailing in the chamber 26, and therefore in the bellows, which consequently releases the mechanical action of the bellows: the plate 19 therefore suddenly rises and applies the closure member 16 against its seat and closes the orifice 15 and allows only a minimum escape flow. The flow of the expanded gas is consequently suddenly reduced to a low value but sufficient to ensure that the device is maintained in the cold state; the pressure drop of the low pressure circuit is correspondingly reduced and the temperature of the liquid contained in the chamber 26 drops to a value in the neighbourhood of the boiling point at atmospheric pressure of the working gas. Furthermore, owing to the fact that the gas flow is very low, the device may be maintained in the cold state during a prolonged period of time.

Note that, before the liquefaction or solidification of the auxiliary gas, only a small volume of this gas is cooled, which substantially does not affect the pressure in the chamber 21, which is located in the warm part, so that the closure member 16 remains up to this time in the fully open position.

The device just described permits at the same time:

obtaining a very short period for cooling the device owing to the high flow of the working gas which is maintained until the end of this period for cooling the device;

obtaining a very low final temperature owing to the maximum reduction in the pressure drop in the low pressure circuit after the cooling of the device;

ensuring an extremely rapid an reliable response of the actuator;

having a very great autonomy of operation owing to the low flow of working gas maintained after the cooling of the device;

suitability for different working gases, in particular argon and nitrogen, owing to the choice of the properties of the changes in the state of the auxiliary gas;

giving relatively large dimensions to the chamber 21, as it is located in the warm part, the same being true for the plate 19 which permits a wide range of choice for the characteristics of the actuator in accordance with the gases employed.

In the variant shown in FIG. 3, the seat 11 formed on the end of the rod 17 has a downwardly extending conical shape. The pipe section 12' is fitted in a pipe 121 extended by a terminal member 122 defining the constriction 30 and communicating through a pipe 150 with the expansion orifice 15 opening onto the frustoconical wall of the seat. The closure member 16 formed in the extension of the rod 17 is advantageously shaped as a stepped double truncated cone having the same conicity as the seat 11, the lower part being thinner so as to form, in the illustrated closed position, a peripheral clearance resulting in an escape flow parallel with the flow of the constriction 30 and reducing the risk of an occlusion of the orifice 15.

I claim:

1. A Joule-Thomson cooler comprising, in a tubular housing having a first end and a second end, said second end defining a cold chamber, a high pressure working gas conduit having, adjacent said first end, one end connectable to a source of high pressure working gas, and which communicates, adjacent said second end, with an expansion orifice formed in a seat of a closing valve and opening in a low pressure working gas return circuit in heat exchange relationship with the high pressure working gas conduit, a closure member adapted for cooperation with the expansion orifice for reducing the section of passage of the working gas, and actuating means for suddenly shifting the closure member from a first position, in which said expansion orifice is uncovered, to a second position in which said expansion orifice is at least partially covered by said closure member, the actuating means comprising, adjacent said second end, a first capacity means having a first volume and in thermal exchange relationship with the low pressure return circuit and, adjacent said first end, a second capacity means having at least one movable wall portion and having a second volume much greater than the first volume, said first and second capacity mans being in fluid communication with each other and being filled with an auxiliary gas, said movable wall portion being coupled to said closure member for actuating said closure member.

2. Cooler according to claim 1, wherein the seat of the closing valve comprising means for establishing an escape flow of the working gas.

3. Cooler according to claim 2, wherein the means for establishing the escape flow comprise a pipe provided with a constriction in parallel with the expansion orifice.

4. Cooler according to claim 2, wherein the closure member is a needle.

5. Cooler according to claim 1, wherein the seat of the closing valve and the closure member comprise means for establishing an escape flow of the working gas.

6. Cooler according to claim 5, wherein the means for establishing the escape flow comprise a pipe provided with a constriction in parallel with the expansion orifice.

7. Cooler according to claim 5, wherein the closure member has a double frustoconical shape and the seat is an annular frustoconical seat cooperating with the closure member.

8. Cooler according to claim 1, wherein the closure member comprises means for establishing an escape flow of the working gas.

9. Cooler according to claim 8, wherein the means for establishing the escape flow comprise a pipe provided with a constriction in parallel with the expansion orifice.

10. Cooler according to claim 8, wherein the means for establishing the escape flow is constituted by a recess in the closure member.

11. The cooler of claim 1, wherein the high pressure working gas conduit is wound around a tubular central core, said second capacity means being partly defined by a bellows having one end wall connected to the closure member by a rod extending axially through said core.

12. The cooler of claim 11, wherein the bellows is resiliently urged in a direction tending to bring said closure member to said second position thereof.

13. The cooler of claim 12, wherein the bellows is at least partly urged by a spring.

14. The cooler of claim 1, wherein the first capacity means is constituted by a coiled tube located in the vicinity of the closing valve seat.

15. The cooler of claim 14, wherein the coiled tube is in fluid communication with the second capacity means via a capillary tube extending along the core.

16. The cooler of claim 15, wherein the second capacity means is a chamber defined between the bellows and a surrounding housing.

* * * * *